US005199232A

United States Patent [19]

Chandler et al.

[11] Patent Number: 5,199,232

[45] Date of Patent: Apr. 6, 1993

[54] CHANNEL FORMING DEWATERING DEVICE

[76] Inventors: Darrell A. Chandler, 335 Beechwood Dr.; Gary E. Money, 116 Autumn Dr., both of Campbellsville, Ky. 42718

[21] Appl. No.: 610,507

[22] Filed: Nov. 8, 1990

[51] Int. Cl.[5] ..... E02D 27/00

[52] U.S. Cl. ..... 52/169.5

[58] Field of Search ..... 52/169.5, 741, 746, 52/242, 288, 287, 717.1

[56] References Cited

U.S. PATENT DOCUMENTS

| | | | |
|---|---|---|---|
| 2,149,026 | 2/1939 | McBride | 52/746 |
| 2,303,864 | 12/1942 | Reasor | 52/287 |
| 3,216,164 | 11/1965 | Stillman | 52/287 |
| 3,344,565 | 10/1967 | Cotten | 52/287 |
| 3,408,250 | 10/1968 | Finefrock | 52/287 |
| 4,198,794 | 4/1980 | Younts, Jr. | 52/169.5 |
| 4,265,064 | 5/1981 | Parezo | 52/169.5 |
| 4,391,071 | 7/1983 | Schantz | 52/169.5 |
| 4,602,124 | 7/1986 | Santucci | 52/287 |
| 4,798,034 | 1/1989 | Jarnagin et al. | 52/169.5 |

*Primary Examiner*—Richard E. Chilcot, Jr.
*Assistant Examiner*—Michele A. Van Patten
*Attorney, Agent, or Firm*—Mark J. Patterson; Edward D. Lanquist, Jr.; I. C. Waddey, Jr.

[57] ABSTRACT

A channel forming dewatering device for use in preventing the penetration of water into an underground room away from a wall. The device provides a baseboard member having an upper flange connected to an angular section. The angular section is, in turn, connected to a vertical section. A bend section attaches a web to the vertical section. A lower flange attaches to said web. The baseboard member is to be placed against a wall proximate to the floor. The upper flange and lower flange contact the wall. The web attaches to the floor with an adhesive such as an epoxy. A flexible liner is placed between the web and the floor. This flexible liner is such that it will better attach to an adhesive. In the preferred embodiment, the flexible lining is extruded with the baseboard member. Grooves are placed through the flexible lining and partially into the web to allow a channel into which the adhesive such as epoxy can flow.

6 Claims, 2 Drawing Sheets

CHANNEL FORMING DEWATERING DEVICE

BACKGROUND OF THE INVENTION

The present invention relates to a device for dewatering a room or basement and more particularly to a channel forming dewatering device that prevents water from advancing into a room or basement.

It will be appreciated by those skilled in the art that basements and other rooms below ground tend to flood because of the water that is under pressure being forced through the walls of a room or basement. Further, those skilled in the art recognize that uncontrolled water can cause mildew, buckling of wood, and other more serious damage. To this end, there have been several attempts to provide a device for dewatering a below ground room.

Once such attempt was disclosed by R. L. Cotten in U.S. Pat. No. 3,344,565, issued Oct. 3, 1967. The Cotten device discloses a "Basement Drain Conduit". The Cotten device catches the seepage as it comes into the walls and directs it down a channel down a drain. However, Cotten did not realize that the plastic conduit is not effectively attached by the adhesives used in this art. Moreover, Cotten did not realize that flooring materials such as concrete often shrink and expand at a greater rate than the plastic conduit.

Another attempt at controlling the flow of liquids is disclosed in U.S. Pat. No. 4,798,034, issued to Jarnagin et al. Jan. 17, 1989. Jarnagin discloses a "Method and Apparatus for Collecting and Discharging Radon Gas and Fluids". Jarnagin did not realize the difficulty in attaching a plastic to a concrete floor. Also, Jarnagin did not realize that the conduit material expands and contracts at a rate much less than the floor and wall materials.

What is needed, then, is a dewatering device that keeps the water from advancing away from the walls. This needed dewatering device must also be made of a material that allows attachment to floor materials such as concrete. Moreover, this dewatering device must also have grooves in it to receive the adhesive to ensure better connection between the device and the floor. However, this device must be inexpensive enough to be economically applied. Such a device is lacking in the prior art.

SUMMARY OF THE INVENTION

In the present invention, a channel forming dewatering device is disclosed. The device has a lower flange that contacts the wall proximate to its intersection with the floor. The device also has a web attached to the lower flange that contacts with the floor proximate to the wall. A bend connects the web with a vertical section. This bend is concave for aesthetic purposes. This device has an angular section following the vertical section that rises toward the wall. After another bend section, an upper flange contacts the wall but is not attached to the wall.

The web of the device is attached to the floor with a standard adhesive such as epoxy. A liner is placed between the web and the floor. This liner is made of a material that adheres to epoxy. At least one groove is placed axially with the web so that the adhesive can reside in the groove, thereby effecting better connection.

If necessary, holes can be drilled in the wall, thereby allowing the water to come in a controlled manner into the channel forming dewatering device. The water is then directed by the device into a drain.

Accordingly, an object of the present invention is to provide a dewatering device that prevents water from advancing into an underground room.

Another object of the present invention is to provide a channel forming dewatering device that can be effectively adhered to the floor.

Still another object of the present device is to provide at least one groove placed axially along the web of the device that receive the adhesive and is used to better secure the device to the floor.

Still another object of the present invention is to provide a dewatering device that, at the top, that will allow any water flowing down the wall to enter the device and be channeled away to a drain by the device.

DESCRIPTION OF THE PREFERRED EMBODIMENT

Figure 1:
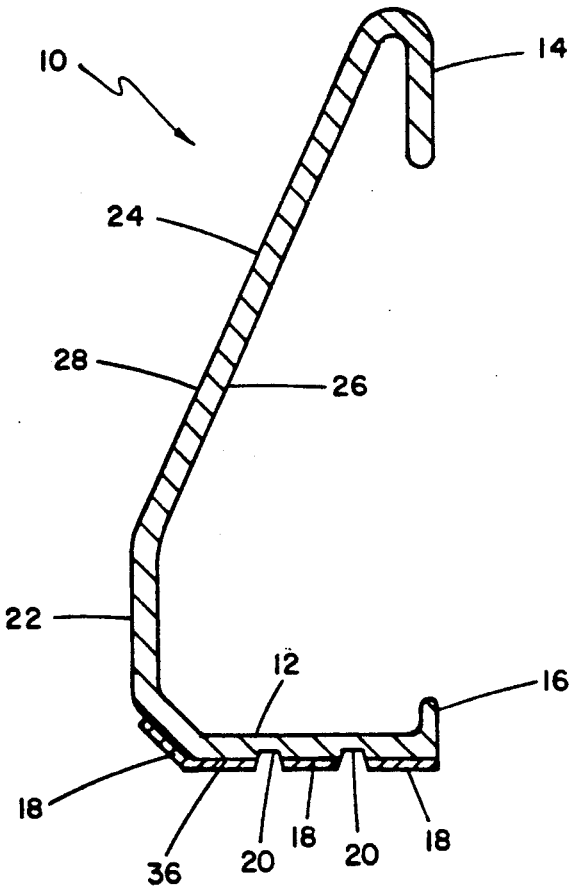
FIG. 1 is a cutaway view of the channel forming dewatering device.
Figure 2:
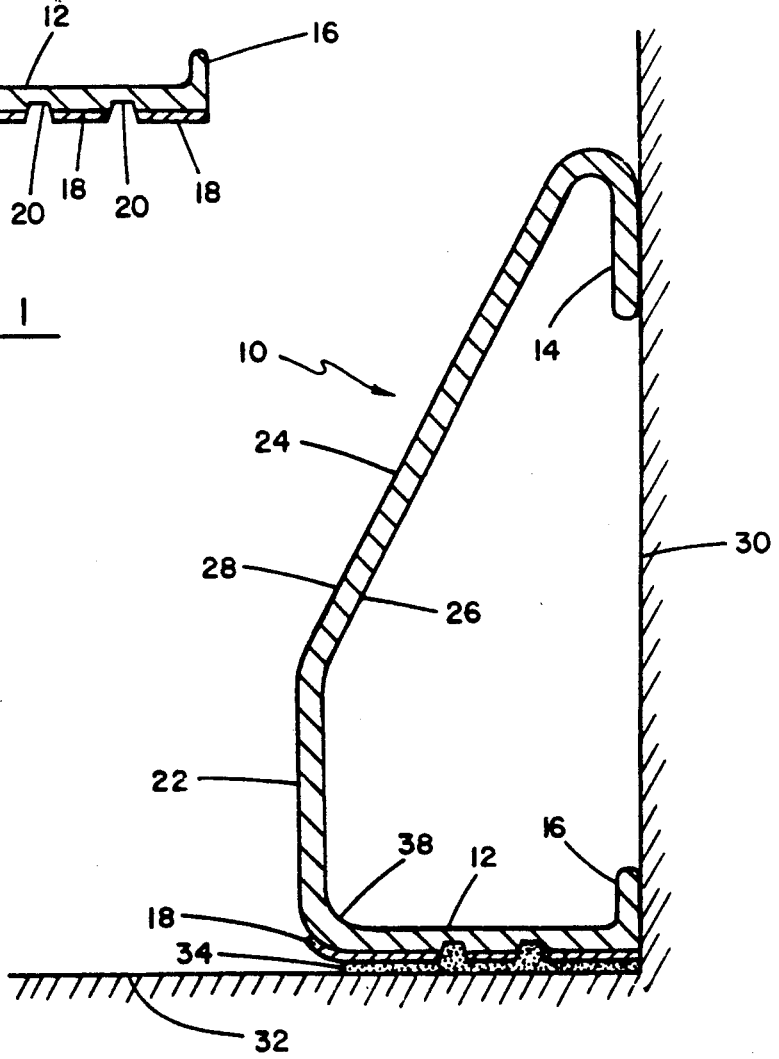
FIG. 2 is a cutaway view showing the attachment of a channel forming dewatering device to the wall and floor of a room.

Referring now to FIGS. 1 and 2, there is shown generally at 10 the baseboard member of the channel forming dewatering device of the present invention. Baseboard member 10 has upper flange 14, lower flange 16, groove 20, vertical section 22, angular section 24, and convex bend 38. Baseboard member 10 also has interior side 26 and exterior side 28. Lower flange 16 contacts with wall 30 at the intersection of wall 30 with floor 32. Lower flange 16 connects with web 12. Web 12 is aligned substantially parallel to floor 32. Vertical section 22 is attached to web 12 by bend 38. In the present invention, bend 38 is convex to allow a better aesthetic appearance of the application of the epoxy to web 12. In the prior art, if the lower bend was convex, the adhesive such as the epoxy would flow outside the plane formed by the vertical section of the dewatering device. After vertical section 22, baseboard member 10 has an angular section 24 which rises toward wall 30. Upper flange 14 contacts with wall 30 and connects to angular section 24. The combination of baseboard member 10 and wall 30 forms a totally enclosed conduit for the direction of water.

As can be seen in FIGS. 1 and 2, flexible liner 18 is placed between web 12 and floor 32. This flexible material is a material that better adheres to standard adhesives used in the art such as epoxy. This flexible liner 18 is also intended to act similar to an expansion joist as floor 32 and baseboard member 10 expand and contract at different rates. In the preferred embodiment, flexible liner 18 is made of flexible vinyl. Also, in the preferred embodiment, flexible liner 18 is extruded in the same process that baseboard member 10 is extruded, thereby integrating flexible liner 18 with baseboard member 10. In the preferred embodiment, baseboard member 10 is made of a rigid vinyl plastic.

As can be seen in FIGS. 1 and 2, grooves 20 are placed axially along web 36, through part of baseboard member 10 and, in the preferred embodiment, through all of flexible liner 18.

Figure 3:
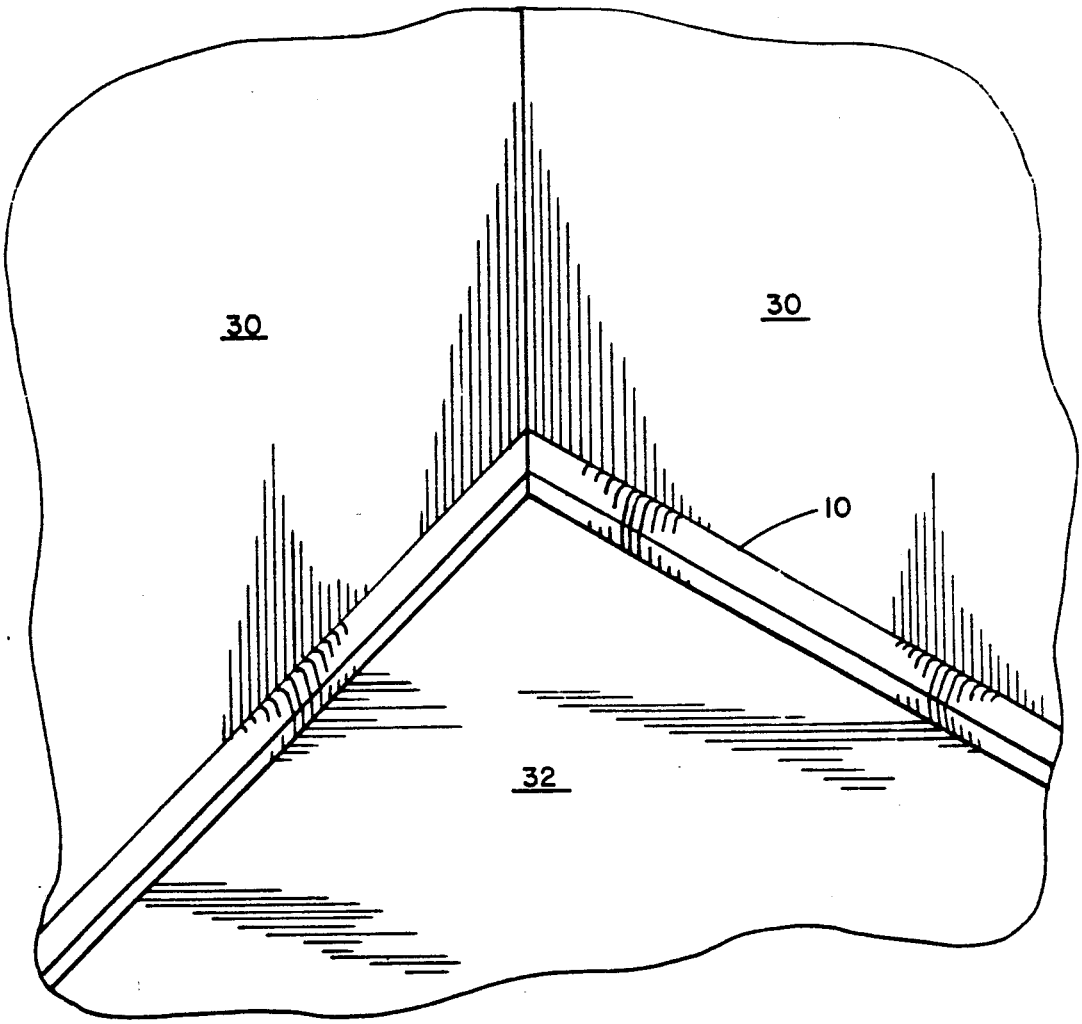
FIG. 3 is a perspective view showing the channel forming dewatering device applied in a room.

As can be seen in FIG. 3, the applier of the present device will lay down adhesive 34 against floor 32 proximate to wall 30. Baseboard member 10 is then cut to the applicable length. Baseboard member 10 is then applied against floor 32 and held in place by adhesive 34. Although adhesive 34 does not contact well with the vinyl of baseboard member 10, the adhesive contacts well with flexible liner 18. Certain excess adhesive 34 is forced up into grooves 20. In the preferred embodiment, grooves 20 are dovetailed in shape such that when adhesive 34 hardens, the hardness of adhesive layer 34 will help hold baseboard member 10 in place.

In the preferred embodiment, as the temperature changes, floor 32 will expand and contract at a rate different from the material of baseboard 10. Therefore, any excess expansion or contraction will be absorbed by flexible liner 18.

In the preferred embodiment, upper flange 14 is substantially 0.930 inches long. In the preferred embodiment, lower flange 16 is substantially 0.25 inches long. In the preferred embodiment, bend 38 rises at substantially a 45° angle. Vertical section 22 rises substantially 1.5 inches above the ground. Angular offset between angular section 24 and vertical section 22 is substantially 23° from vertical. The vertical distance from the connection between vertical section 22 and angular section 24 to the top of baseboard member 10 is substantially 3.375 inches. Baseboard member 10 is substantially 0.09 inches thick above vertical section 22. Web 36 is substantially 0.1 inch thick.

Thus, although there have been described particular embodiments of the present invention of a new and useful channel forming dewatering device, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A channel forming dewatering device for placement against a wall and attachment to a floor with an adhesive comprising:

a. a baseboard member for attachment to said floor with said adhesive;

b. a flexible liner placed between said baseboard and said floor, said flexible liner being attached to said baseboard member and adhering to said floor with said adhesive, said flexible liner allowing movement of said baseboard member with respect to said floor;

c. a lower flange that contacts with said wall proximate to said floor;

d. a web attached to said lower flange, said web attached to said floor proximate to said wall;

e. a bend attached to said web away from said lower flange;

f. a vertical section rising vertically from attachment to said bend;

g. an angular section attached to said vertical section;

h. an upper flange attached to said angular section such that said lower flange and said upper flange are in substantially alignment, and said upper flange contacts said wall; and i. wherein said web and said liner are integrally constructed.

2. A channel forming dewatering device for placement against a wall and attachment to a floor with an adhesive comprising;

a. a baseboard member for attachment to said floor with said adhesive;

b. a flexible liner placed between said baseboard and said floor, said flexible liner being attached to said baseboard member and adhering to said floor with said adhesive, said flexible liner allowing movement of said baseboard member with respect to said floor; and c. wherein said baseboard member and said liner are integrally constructed.

3. A channel forming dewatering device for placement against a wall and attachment to a floor with an adhesive comprising;

a. a baseboard member for attachment to said floor with said adhesive;

b. a flexible liner placed between said baseboard and said floor, said flexible liner being attached to said baseboard member and adhering to said floor with said adhesive, said flexible liner allowing movement of said baseboard member with respect to said floor; and c. wherein said baseboard member and said liner have a groove placed through them to receive said adhesive.

4. A channel forming dewatering device for placement against a wall and attachment to a floor with an adhesive comprising;

a. a baseboard member for attachment to said floor with said adhesive;

b. a flexible liner placed between said baseboard and said floor, said flexible liner being attached to said baseboard member and adhering to said floor with said adhesive said flexible liner allowing movement of said baseboard member with respect to said floor; and c. wherein said baseboard member and said liner have a groove placed through them to receive said adhesive and wherein said groove is dove-tailed.

5. A channel forming dewatering device comprising;

a. a baseboard member for attachment with an adhesive to a floor proximate to a wall;

b. said baseboard member having axial grooves placed through it, said grooves running parallel to said wall to receive said adhesive; and c. a flexible liner is made of flexible vinyl having second grooves running through it said second grooves in substantial alignment with said axial grooves, said flexible liner attached to said baseboard member proximate said axial grooves, said flexible liner allowing movement of said baseboard member in relation to said floor.

6. A method of manufacturing a channel forming dewatering device comprising the steps of:

a extruding a baseboard member comprising and upper flange, an angular section, a vertical section, a bend, a web, and a lower flange, said baseboard member extruded with a flexible lining attached to said web; and b. placing a groove running axially along said web and said baseboard through said flexible lining and partially through said web, running axially along said web and said baseboard member such that said adhesive can flow into said groove.

* * * * *